US005529467A

United States Patent [19]

Rometsch

[11] Patent Number: 5,529,467

[45] Date of Patent: Jun. 25, 1996

[54] CONNECTING ROD FOR A MULTIPLE COMPRESSOR PUMP

[75] Inventor: Rainer Rometsch, Wildberg, Germany

[73] Assignee: Hewlett-Packard Company, Palo Alto, Calif.

[21] Appl. No.: 512,155

[22] Filed: Aug. 7, 1995

[30] Foreign Application Priority Data

Sep. 16, 1994 [DE] Germany ..... 44 33 068.5

[51] Int. Cl.[6] ..... F04B 43/02; F16H 21/18

[52] U.S. Cl. ..... 417/534; 417/413.1; 417/521; 74/49; 74/579 R; 74/579 E; 403/220; 403/291; 92/138

[58] Field of Search ..... 417/413.1, 521, 417/534; 74/49, 579 R, 579 E; 403/220, 291; 92/137, 240, 138

[56] References Cited

U.S. PATENT DOCUMENTS

| | | | |
|---|---|---|---|
| 1,689,179 | 10/1928 | Strebler | 417/549 |
| 2,392,117 | 1/1946 | Burks | 417/534 |
| 3,659,502 | 5/1972 | Friedman et al. | 92/84 |
| 4,065,977 | 1/1978 | Buzzi et al. | 74/49 |
| 4,329,915 | 5/1982 | Schulz | 74/579 R |

FOREIGN PATENT DOCUMENTS

| | | | |
|---|---|---|---|
| 2330884 | 6/1975 | France . | |
| 2307987 | 4/1976 | France | 417/534 |
| 3049733C2 | 5/1980 | Germany . | |
| 3340817C2 | 5/1986 | Germany . | |
| 53-88463 | 8/1978 | Japan | 74/49 |
| 53-88464 | 8/1978 | Japan | 74/49 |

OTHER PUBLICATIONS

Konstruktionselemente der Feinmechanik/Hrsg. Werner Krause—Hanser, 1993–pp. 391–395.

*Primary Examiner*—Peter Korytnyk

[57] ABSTRACT

A connecting rod used for a multiple chamber compressor pump comprises a central section having in the main surface thereof an opening for receiving therein a bearing for an eccentric of the multiple compressor pump, at least two pushing sections, and respective hinge areas arranged between the central section and the pushing sections and generating restoring forces, when the pushing sections are deflected relative to the central area.

10 Claims, 4 Drawing Sheets

CONNECTING ROD FOR A MULTIPLE COMPRESSOR PUMP

FIELD OF THE INVENTION

The present invention refers to a connecting rod for a multiple chamber compressor pump. In particular, the present invention refers to a connecting rod for multiple compressor diaphragm pumps.

DESCRIPTION OF THE PRIOR ART

Diaphragm pumps are known among those skilled in the art and are primarily used as air pumps; they are used in many fields of everyday life, such as in the field of car manufacture, as tire inflator, in gas analysis devices, in medical devices and in the field of aquanistics.

FIG. 6 shows the structural design of a conventional diaphragm pump.

This conventional diaphragm pump comprises a housing 600 and a motor 602. The motor 602 drives an eccentric 606 via its motor shaft 604. This eccentric 606 is accommodated in a bearing 608 of the connecting rod 610. The end of the connecting rod 610 which is remote from the bearing 608 is connected to a diaphragm 616 via a disk 612 and a screw 614.

The diaphragm 616 defines together with a lower section of said housing 600 a compressor chamber 618 communicating with the surroundings via an inlet valve 620, an outlet valve 622 and a connection plate 624. The connection plate 624 is connected to the lower part of said housing 600 via a seal 626, said seal 626 comprising the inlet valve 620 and the outlet valve 622 which are formed integrally therewith.

The motor 602 drives the diaphragm 616 via the eccentric 606, the bearing 608 and the connecting rod 610, and moves said diaphragm 616 "up and down". The diaphragm 616 compresses the air in the compressor chamber 618 during its downward movement and urges it outward through the outlet valve 622. During its upward movement, the diaphragm 616 sucks in air through the inlet valve 620.

The control valves 620, 622 (inlet and outlet valves) are preferably so-called flutter valves which are controlled by the air current or rather by the pressure difference in front of and behind the valve. In addition to the flutter valves, also so-called umbrella-type and flute-type valves or other seat valves are used.

The fastening of the diaphragm 616 by means of the disk 612 and the screw 614 is takes place on a planar portion of the connecting rod 610.

In order to save weight and power or in view of the fact that such pumps are intended to be used in portable devices, a tendency towards miniaturization exists in the field of diaphragm pumps.

If, however, the dimensions are reduced in size, the possible diaphragm diameter will be reduced in size as well, and this must be compensated for by a higher motor speed or by a longer stroke so as to achieve the same pumping capacity in liters as before. There are, however, natural as well as practical limits to the motor speed and the stroke.

The high efficiency desired and the low-pulsation delivery aimed at in connection with many modes of application leads to a so-called "multiple compressor pump". This is a pump which includes two or more compressor chambers, diaphragms, connecting rods, etc., which are arranged such that they are displaced relative to one another. One advantage of these multiple compressor pumps is to be seen in the fact that the torque for the motor is rendered more uniform and can therefore be maintained more easily in a maximum efficiency range of the motor.

In order to permit a production of economy-priced pumps, the functions of a plurality of parts are combined in one part, whereby the necessary number of parts and the amount of assembly work required will be reduced.

In connection with multiple compressor pumps, this is all the more necessary in view of the fact that the number of parts required increases here more rapidly.

In known multiple chamber compressor pumps, the diaphragm and the connecting rod, for example, are produced from an elastomeric part, the two valves are produced from a stamping, or the valves are attached to the elastomeric connecting rod/diaphragm combination.

FIGS. *7a* and *7b* show a representation of a known duplex compressor pump.

The duplex compressor pump, which is shown in FIG. *7a* in a cross-sectional view, comprises, in principle, two of the single compressors shown in FIG. 6, said single compressors being arranged on a common motor shaft such that they are displaced relative to one another by 180°.

In FIGS. *7a* and *7b*, elements of the duplex compressor pump which correspond to the elements of the pump shown in FIG. 6 are designated by the same reference numerals.

The duplex compressor pump in FIG. *7a* comprises a housing 600 and a motor 602. The motor drives via its shaft 604 the eccentric 606, which is accommodated in a first bearing 708 and in a second bearing 710 of a first connecting rod 712 and of a second connecting rod 714. The ends of said first and second connecting rods 712, 714 which face away from the motor are connected to a first diaphragm 716 and to a second diaphragm 718, respectively. These diaphragms 716, 718 define together with the housing 600 first and second compressor chambers 720, 722. First and second connector plates 724, 726 are connected to said housing 600 via first and second seals 728, 730. Just as in the pump according to FIG. 6, the input and output valves are formed integrally with the respective seal.

FIG. *7b* shows a top view of the pump described in connection with FIG. *7a*. The corresponding elements of this pump are designated by the same reference numerals as in FIG. *7a*.

As can be seen in FIG. *7a*, connecting rods 712, 714, diaphragms 716, 718, control valves and connecting-rod bearings 708, 710 are required for the respective compressor chambers 720, 722. The longitudinal dimensions of the pump are thus increased by the width of the connecting-rod combination and the point of application for the additional compressor 714 migrates away from the motor bearing. This results in an increased load on the motor bearing and in an increased bending load on the motor shaft, and this will exert a negative influence on the service life of the motor and necessitate an overdefined third motor shaft bearing under certain circumstances. Furthermore, due to the throw of the eccentric, the angle at which the two connecting rods 712, 714 are positioned relative to each other constantly changes during each rotation. For this reason, a bearing 708, 710 is required for each connecting rod 712, 714.

In FIG. 8, an additional duplex compressor diaphragm pump, which includes a slider crank, is shown.

This pump comprises a housing 600 and a motor 602. A rotating pin 800, which is arranged eccentrically with respect to the motor shaft 602, moves a crank "to and fro" and, in so doing, it slides in a slider crank 802.

The other elements of this pump correspond to the elements of the pump which has been described on the basis of FIG. 7.

The advantage of this arrangement is to be seen in the fact that a second connecting-rod bearing can be dispensed with.

It is, however, necessary to provide a precise fit between the pin 800 and the slider crank 802, and this will result in higher costs.

The movement of the pin in the slider crank causes a sliding friction, whereby wear will be caused. The amount of play will, consequently, be increased, and this will result in more noise and in a change in the pneumatic parameters, i.e. the maximum pressure, the delivery capacity, etc. will decrease.

DE-3718967 A1 describes a so-called wobble-plate pump. In this known pump, an obliquely arranged pin rotates eccentrically with respect to the motor shaft and, in so doing, it moves a connecting rod in such a way that two or more diaphragms, which are arranged on a circle, are moved up and down.

The small diameter of the pin of this known pump causes a high surface pressure in the bearing, and this will have the effect that the bearing is highly susceptible to wear.

SUMMARY OF THE INVENTION

It is a major object of the present invention to provide an economy-priced, small-size connecting rod means for a multiple chamber compressor pump.

In accordance with a first aspect of the invention, this object is achieved by a connecting rod means for a multiple chamber compressor pump, said connecting rod means comprising:

a central section having in the main surface thereof an opening for receiving therein a bearing for an eccentric of said multiple compressor pump;

at least two pushing sections; and respective hinge areas arranged between said central section and said pushing sections, each of said hinge areas being constructed such that, when the pushing section is deflected relative to the central area, restoring forces are generated.

Another major object of the present invention is to provide an economy-priced, small-size multiple compressor pump.

In accordance with a second aspect of the invention, this object is achieved by a multiple chamber compressor pump including a connecting rod means, two diaphragm areas and control valve areas, wherein the diaphragm areas and control valve areas consist of the same material as the connecting rod means and are formed integrally therewith, said connecting rod means comprising:

a central section having in the main surface thereof an opening for receiving therein a bearing for an eccentric of said multiple compressor pump;

at least two pushing sections; and respective hinge areas arranged between said central section and said pushing sections, each of said hinge areas being constructed such that, when the pushing section is deflected relative to the central area, restoring forces are generated.

An advantage of the present invention is to be seen in the fact that, due to the use of the connecting rod means according to the present invention, a multiple chamber compressor pump is realized, which has a good efficiency and which comprises a minimum number of parts due to the combination of various functions.

An additional advantage of the present invention is to be seen in the fact that the dimensions of a pump including the connecting rod means according to the invention can be kept small and that the loads applied to the motor shaft and to the bearing are less high; this will have a positive effect on the service life of the pump.

According to a preferred embodiment, the present invention provides an integral connecting rod/diaphragm combination by means of which the number of components required can essentially be reduced, whereby the assembly operation will be simplified, the assembly times will be shortened, and the costs for the individual components will be lowered. In view of the fact that the assembly operation is simplified, there are less possibilities of making mistakes and the quality level will be enhanced. Furthermore, the amount of work required for logistics (purchase, stockkeeping etc.) will be reduced, and this results in a more economy-priced product.

BRIEF DESCRIPTION OF THE DRAWINGS

Preferred embodiments of the present invention will be described in detail hereinbelow on the basis of the drawings enclosed, in which.

DESCRIPTION OF THE PREFERRED EMBODIMENTS OF THE INVENTION

Prior to describing hereinbelow a preferred embodiment of the present invention on the basis of the figures enclosed, the functional principle of the present invention is explained in detail on the basis of FIG. 1.

Figure 1:
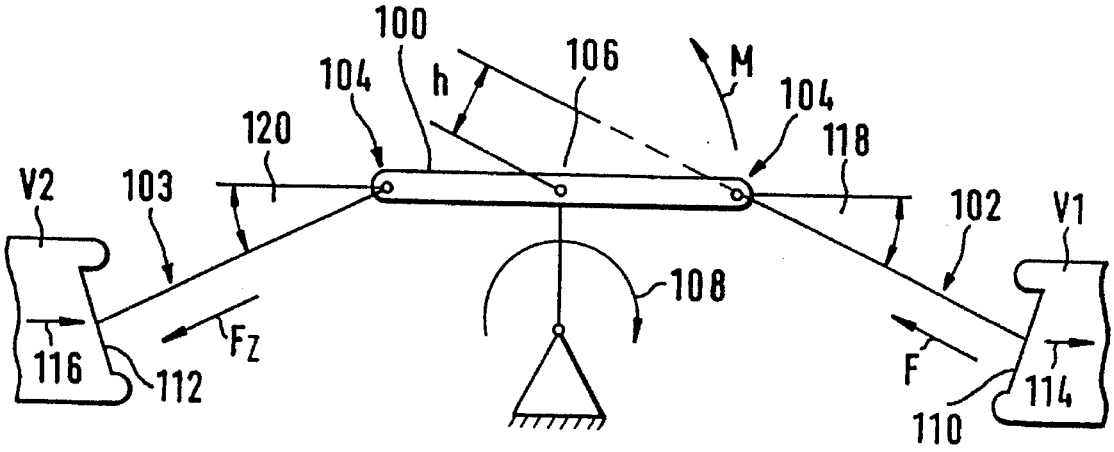
FIG. 1 shows a representation of the functional principle of the connecting rod means according to the present invention.

FIG. 1 is a schematic representation of the connecting rod means according to the present invention. The connecting rod means comprises a central section 100 as well as pushing sections 102, 103. Areas 104, which act as hinges and which permit a necessary deflection, are formed between said central section 100 and said pushing sections 102, 103. Due to this arrangement, it suffices to provide only one bearing 106 on the motor shaft for supporting an eccentric. The direction of rotation is shown by arrow 108.

A first diaphragm 110 of the first compressor V1 and a second diaphragm 112 of the second compressor V2 essentially represent a linear bearing.

During compression (represented by arrow 114) in the compressor V1, a torque M is generated by a force F via the pushing section 102 and the effective lever arm h. The second compressor V2 sucks in air (represented by arrow 116) so that a tractive force FZ becomes effective via the pushing section 103, said tractive force FZ generating a torque having the same sense of rotation.

In order to prevent the central section 100 from rotating about the bearing 106, the hinges 104 must produce restoring forces when a deflection takes place.

If the central section 100 tries to rotate, an angle Ó 118 and the restoring force will increase on the compressor side 114, whereas, on the intake side 116, the angle β 120 and the restoring force will decrease. This will counteract the rotation of the central section 100 and have the effect that the connecting rod endeavors to adjust identical angles 118, 120 on both sides. This is very important with regard to the compression ratios, since, if the central section 100 rotated, the dead center would be displaced so that the compression ratio and, consequently, the delivery capacity and the maximum pressure would decrease.

In addition, the maximum deflection of the pushing sections 102, 103 can be limited to a degree which is necessary for the operability of the device in such a way that the restoring forces increase overproportionally with respect to the increase in the deflection, and this will support the endeavor to adjust identical angles.

It is pointed out that the influence of the torques, which act on the drive of the pump clue to the restoring forces, is insignificant, since the maximum forces will occur when the respective effective lever arm with respect to the motor shaft is zero.

Such a behavior can be achieved e.g. by selecting an appropriate material, by the shape chosen, or by material and shape in combination.

In accordance with a preferred embodiment of the present invention, the material used is e.g. caoutchouc, which, due to its elastomeric properties, permits the function of the diaphragm, the valves, the seal and the hinges, but which, when provided with suitable dimensions, is stiff enough for acting as a force-transmitting connecting rod.

According to the present preferred embodiment, the connecting rod and the diaphragm/connecting rod combination, respectively, can be an integral part, whereby the number of parts and the costs will essentially be reduced.

Figure 2:
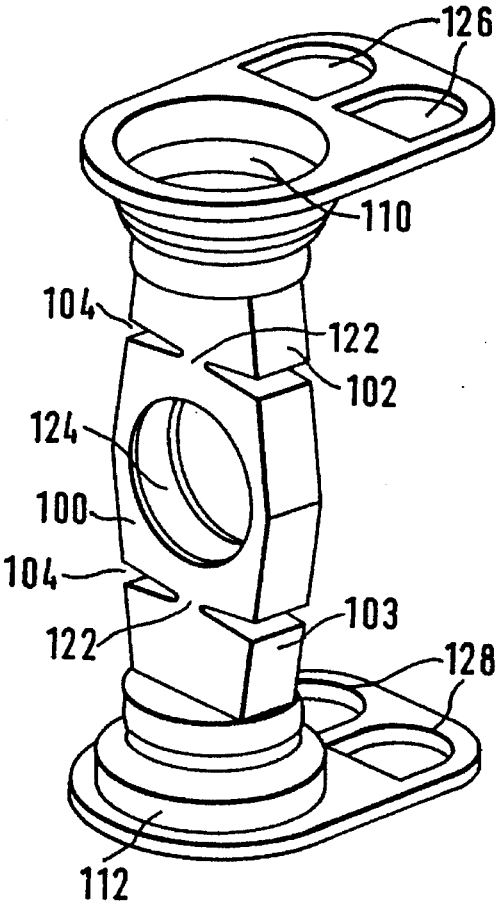
FIG. 2 shows an embodiment of the connecting rod means according to the present invention.
Figure 3:
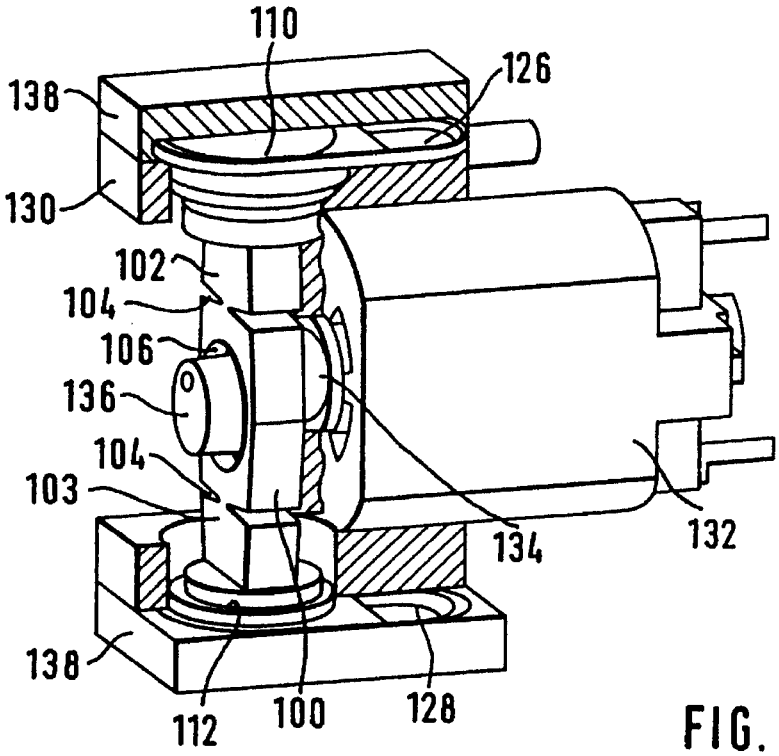
FIG. 3 shows a sectional view of a duplex compressor pump making use of the connecting rod means according to the present invention.

A preferred embodiment of the present invention will now be described on the basis of FIGS. 2 and 3. In FIGS. 2 and 3, elements which correspond to the elements shown in FIG. 1 are designated by the same reference numerals.

In FIG. 2, a connecting rod/diaphragm combination for a duplex compressor pump is shown.

The combination comprises the central section 100, the pushing sections 102, 103 and the hinges 104.

As can be seen, the hinge areas are formed by webs 122 in this preferred embodiment.

The central section 100 is provided with an opening 124 for receiving therein the connecting-rod bearing for the eccentric of the duplex compressor pump.

The connecting rod/diaphragm combination additionally comprises the first diaphragm 110, the second diaphragm 112, the first control valves 126 and the second control valves 128. The connecting rod, the diaphragms and the control valves are here formed integrally with one another.

It is obvious that, depending on the number of compressors used, the pushing sections 102, 103, the hinge areas 104, the diaphragms 110, 112 and the control valves 126, 128 can be provided more than once.

FIG. 3 shows a cross-sectional view of a duplex compressor pump making use of the connecting-rod/diaphragm combination described in FIG. 2.

This duplex compressor pump comprises a housing 130 provided with respective openings for receiving therein the connecting rod/diaphragm combination and the motor 132.

The motor comprises a shaft having arranged thereon an eccentric 136, which is received in the bearing 106 of the connecting rod/diaphragm combination.

Compressor chambers are formed by respective compressor lids 137, 138 arranged on said housing 130 and by the diaphragms 110, 112.

Figure 4:
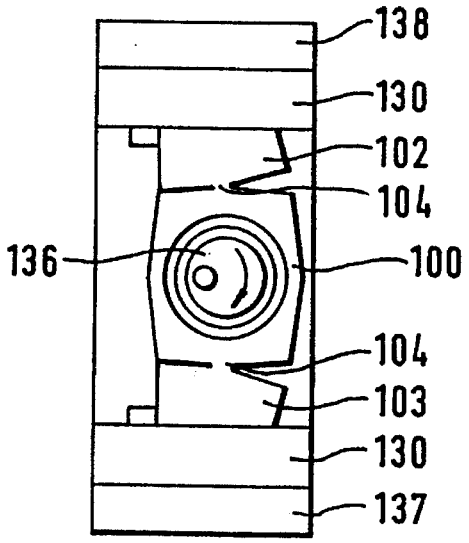
FIG. 4 shows a deflection of the connecting rod means according to the present invention during operation.

FIG. 4 shows the connecting rod/diaphragm combination according to FIG. 2 and 3 at a position of maximum deflection. This figure clearly shows the mode of operation of the hinges 104 and the above-described limitation of the deflection angle. In addition to the selection of the material used (degree of hardness), which has a decisive influence on the function of the diaphragm 110, 112 and of the control valves 126, 128 and which prevents excessive degrees of freedom, the restoring force and its characteristic can be adjusted by providing the hinges 104 with a suitable structural design.

This structural design of the hinges will now be described in detail on the basis of FIG. 5*a* to 5*c*.

Figure 5A:
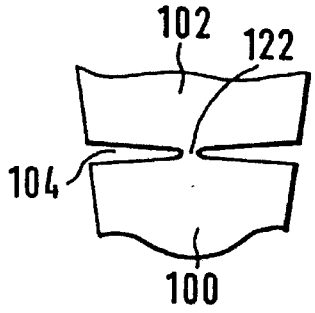
FIG. 5*a* to 5*c* show various embodiments of the hinge area.

In FIG. 5*a*, the hinge area 104 comprises a narrow web 122, whereby a flat characteristic of the restoring forces will be obtained.

Figure 5B:
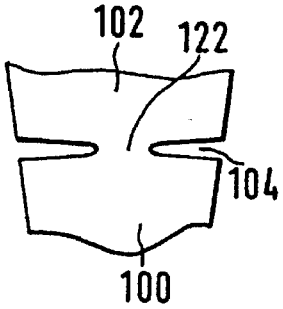

In FIG. 5*b* the broader width of the web 122 results in a steeper characteristic of the restoring forces.

Figure 5C:
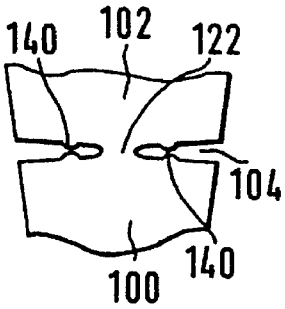
Figure 6:
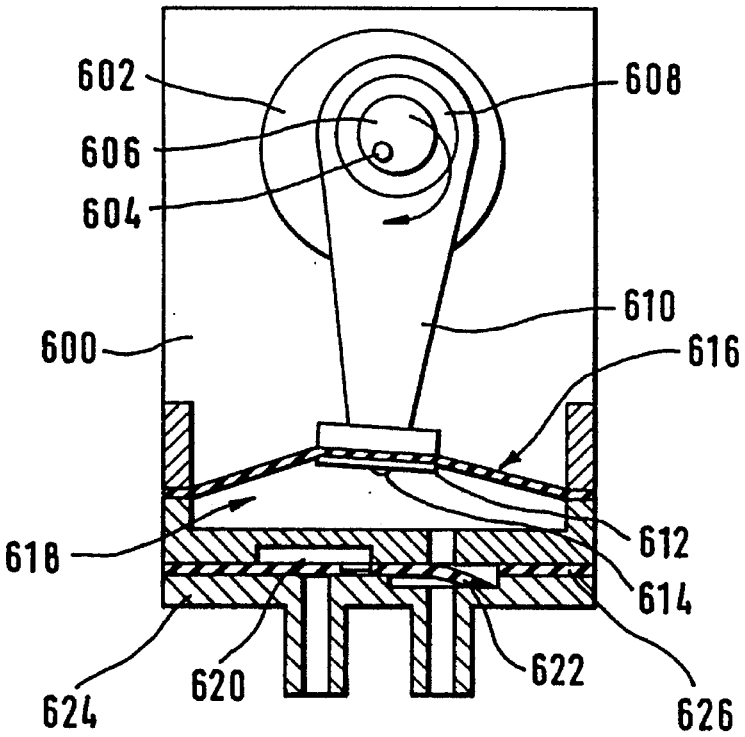
FIG. 6 PRIOR ART
FIG. 6 shows a conventional diaphragm pump.
Figure 7A:
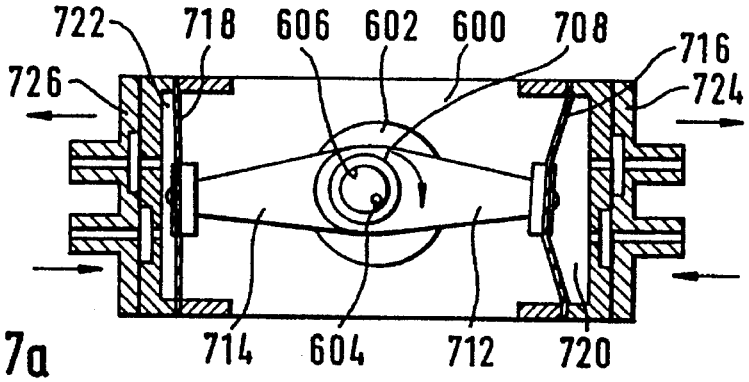
FIG. 7a PRIOR ART
FIG. 7*a* and 7*b* show a cross-sectional view and a top view of a known duplex compressor pump.
Figure 7B:
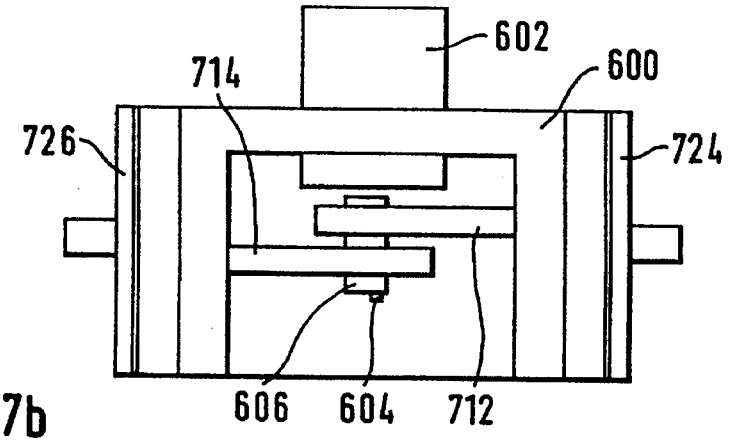
FIG. 7b PRIOR ART
Figure 8:
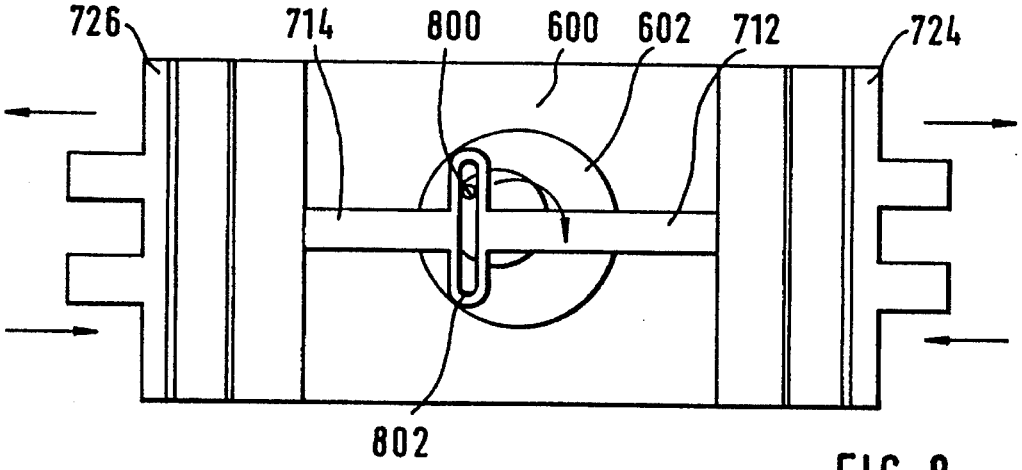
FIG. 8 shows a top view of a duplex compressor pump including a slider crank.

FIG. 5*c* discloses that, in addition to the web 122, which is defined by so-called notch areas, stop means 140 are provided in these notch areas, said stop means 140 having the effect that, from a specific deflection angle onwards, an additional force is required for causing elastic deformation, since the stop means 140 contact each other and the characteristic of the restoring forces increases overproportionally.

It is obvious that, instead of the caoutchouc material used for the preferred embodiment, other elastomeric material having the above-described properties may be used.

Furthermore, it is obvious that the number of pushing sections and the number of hinge areas connected thereto is not limited to two, but that a plurality of said pushing sections and hinge areas can be provided.

In addition, the present invention also comprises multiple chamber compressor pumps in which the connecting rod means, the diaphragm areas and the control valve areas are not formed integrally with one another, but are produced from different materials.

Reference is made to the fact that the hinge area is not limited to the embodiment described hereinbefore, but that any structural design may be used, which generates restoring forces when the pushing section is deflected relative to the central section.

I claim:

1. A multiple chamber compressor pump including a connecting rod means, two diaphragm areas and control valve areas, wherein the diaphragm areas and control valve areas consist of the same material as the connecting rod means and are formed integrally therewith, said connecting rod means comprising:

a central section having in a main surface thereof an opening for receiving therein a bearing for an eccentric of said multiple compressor pump;

at least two pushing sections; and respective hinge areas arranged between said central section and said pushing sections, each of said hinge areas being constructed such that, when the pushing section is deflected relative to the central area, restoring forces are generated.

2. A multiple chamber compressor pump according to claim 1, wherein said connecting rod means is produced from an elastomeric material.

3. A multiple chamber compressor pump according to claim 2, wherein the elastomeric material is caoutchouc.

4. A multiple chamber compressor pump according to claim 1, wherein the hinge area is a web.

5. A multiple chamber compressor pump according to claim 4, wherein notch areas, which define the web, are provided with stop means for limiting the deflection of the pushing section relative to the central section.

6. A connecting rod means for a multiple chamber compressor pump, comprising:

a central section having in a main surface thereof an opening for receiving therein a bearing for an eccentric of said multiple chamber compressor pump;

at least two pushing sections; and respective hinge areas arranged between said central section and said pushing sections, each of said hinge areas being constructed such that, when the pushing section is deflected relative to the central area, restoring forces are generated.

7. A connecting rod means according to claim 6, which is produced from an elastomeric material.

8. A connecting rod means according to claim 7, wherein the elastomeric material is caoutchouc.

9. A connecting rod means according to claim 6, wherein the hinge area is a web.

10. A connecting rod means according to claim 9, wherein notch areas, which define the web, are provided with stop means for limiting the deflection of the pushing section relative to the central section.

* * * * *

UNITED STATES PATENT AND TRADEMARK OFFICE
CERTIFICATE OF CORRECTION

PATENT NO. : 5,529,467

DATED : June 25, 1996

INVENTOR(S) : Rainer Rometsch

It is certified that error appears in the above-identified patent and that said Letters Patent is hereby corrected as shown below:

At Col. 6, line 60, "means" should be deleted.

At Col. 6, line 63, "means" should be deleted.

At Col. 6, line 64, "means" should be deleted.

At Col. 7, line 8, "means" should be deleted.

At Col. 7, line 18, "means" should be deleted.

At Col. 8, line 15, "the" should read --each--.

Signed and Sealed this

Third Day of June, 1997

*Attest:*

Bruce Lehman

BRUCE LEHMAN

*Attesting Officer*

*Commissioner of Patents and Trademarks*